US007921879B2

(12) United States Patent
Eschweiler

(10) Patent No.: US 7,921,879 B2
(45) Date of Patent: Apr. 12, 2011

(54) CONTROL VALVE FOR A HYDRAULIC MOTOR

(75) Inventor: Markus Eschweiler, Remscheid (DE)

(73) Assignee: Bucher Hydraulics AG, Neuheim (CH)

( * ) Notice: Subject to any disclaimer, the term of this patent is extended or adjusted under 35 U.S.C. 154(b) by 841 days.

(21) Appl. No.: 11/918,688

(22) PCT Filed: Dec. 1, 2005

(86) PCT No.: PCT/CH2005/000717

§ 371 (c)(1),
(2), (4) Date: Oct. 17, 2007

(87) PCT Pub. No.: WO2006/111031

PCT Pub. Date: Oct. 26, 2006

(65) Prior Publication Data

US 2009/0078112 A1 Mar. 26, 2009

(30) Foreign Application Priority Data

Apr. 20, 2005 (CH) ..... 0707/05

(51) Int. Cl.
*F16K 11/07* (2006.01)

(52) U.S. Cl. ..... 137/625.68; 137/625.69

(58) Field of Classification Search ..... 137/625.67, 137/625.68, 625.69
See application file for complete search history.

(56) References Cited

U.S. PATENT DOCUMENTS

| | | | | |
|---|---|---|---|---|
| 3,265,088 | A | 8/1966 | Williams | |
| 3,738,379 | A | 6/1973 | Wilke | |
| 4,232,584 | A * | 11/1980 | Fassbender | 91/418 |
| 4,413,650 | A * | 11/1983 | Kropp | 137/596.13 |
| 7,581,562 | B2 * | 9/2009 | Steinhilber et al. | 137/625.68 |
| 2004/0226292 | A1 | 11/2004 | Luo | |

FOREIGN PATENT DOCUMENTS

| | | |
|---|---|---|
| DE | 39 41 802 | 6/1991 |
| DE | 41 36 991 | 5/1993 |

OTHER PUBLICATIONS

Search Report dated Mar. 13, 2006 issued for the corresponding International Application No. PCT/CH2005/000717.

* cited by examiner

*Primary Examiner* — Craig M Schneider
(74) *Attorney, Agent, or Firm* — Cohen Pontani Lieberman & Pavane LLP

(57) ABSTRACT

A pilot valve (3) is designed as a directional control valve in which a control slide (20) is movably disposed in a longitudinal bore (22) of the valve body (21) so as to control the flow of hydraulic oil between two working connecting bores (A, B), a pump connecting bore (P), and a reservoir connecting bore (T). A check valve (32) which is biased with the aid of a bias spring (33) is disposed within the control slide (20). The check valve (32) is connected to an auxiliary control groove (28) via a first transversal bore (29) while being connected to the B-reservoir groove (23) via a second transversal bore (31). The check valve (32) is to be opened from working connecting bore B while the auxiliary control groove (28) is arranged between the B control groove (24) and the B reservoir groove (23) and is delimited on both sides by means of sealing cylindrical areas (35, 36).

8 Claims, 3 Drawing Sheets

CONTROL VALVE FOR A HYDRAULIC MOTOR

CROSS-REFERENCE TO RELATED APPLICATIONS

This is a U.S. national stage of International Application No. PCT/CH2005/000717, filed on 1 Dec. 2005. Priority is claimed on Switzerland Application No. 707/05, filed on Apr. 20, 2005.

BACKGROUND OF THE INVENTION

1. Field of the Invention

The invention pertains to a control valve for a hydraulic motor used for lifting loads, in particular a directional control valve of the type having a control slide installed in a longitudinal bore of a valve body with freedom to move axially to control the flow of hydraulic oil between two working connection bores, a pump connection bore, and a tank connection bore.

2. Description of the Related Art

Hydraulic motors are used in cranes, for example, to drive hydraulic winches. A winch of this type can lift and lower loads.

A hydraulic directional control valve which makes it possible to control a hydraulic motor independently of the load pressure is known from DE 39 41 802 A1. A directional control valve which can be used for the same purpose is known from DE 41 36 991 C2.

Because of the way in which hydraulic motors, usually designed as axial piston machines or more rarely as radial piston machines, work, it is unavoidable for design reasons that the delivery stream does not flow uniformly but rather fluctuates cyclically; that is, it pulses, as mentioned, for example, on pages 31 and 353-354 of the book by H. Ebertshäuser entitled "Fluidtechnik von A bis Z" ["Fluid Engineering from A to Z"], Vereinigte Fachverlage Krausskopf/Ingenieur-Digest, 1st edition, 1989. This leads unavoidably to torque fluctuations, which become especially bothersome at low rpm's. When a load, initially at rest, is lifted, the transition to the moving state occurs with more or less of a jerk. The same effect occurs when the load has almost reached its intended final position. Pulsations in the movement of the load are very troublesome in this situation also.

SUMMARY OF THE INVENTION

The invention is based on the task of creating a control valve which prevents the previously described torque fluctuations and pulsations without the need for an additional valve assembly as used in the past to reduce pulsations and torque fluctuations.

The task just described is accomplished according to the invention by a control slide having a first working connection bore to tank groove, a first control groove, a pump groove, and a second control groove. The control slide further includes an auxiliary control groove located between the first control groove and the pump groove, the auxiliary control groove being limited on both sides by cylindrical sealing surfaces; a longitudinal bore in the control slide; a first transverse bore connecting the auxiliary control groove to the longitudinal bore in the control slide; and a second transverse bore connecting the first working connection bore to tank groove to the longitudinal bore in the control slide. A spring-loaded check valve in the longitudinal bore in the control slide can be opened by flow from the first working connection bore via the auxiliary control groove and the first transverse bore in the control slide.

DETAILED DESCRIPTION OF THE PREFERRED EMBODIMENTS

Figure 1:
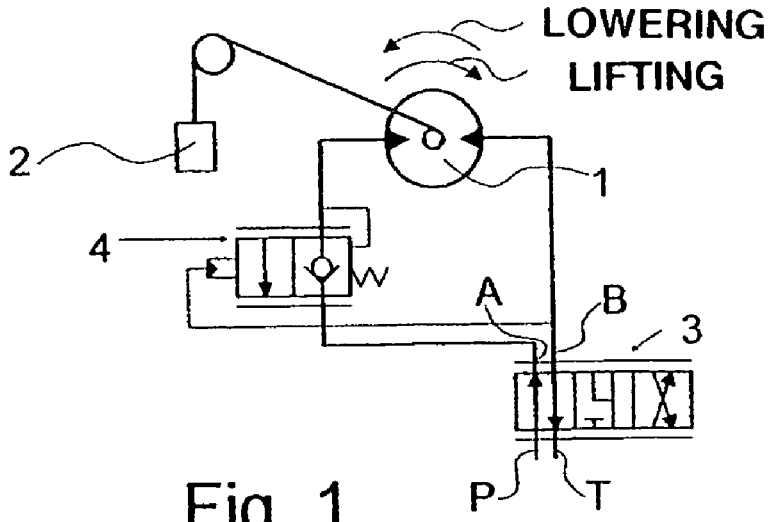
Fig. 1 (PRIOR ART)
FIG. 1 shows a diagram of a control system for a hydraulic motor.

FIG. 1 shows a hydraulic motor 1, which drives a cable winch (not shown) for lifting and lowering a load 2. Arrows on the hydraulic motor 1 show that one rotational direction of the hydraulic motor lowers the load 2, whereas the opposite rotational direction of the hydraulic motor 1 lifts the load. The hydraulic motor 1 can be controlled by a control valve 3, designed as a directional control valve, with the conventional load connections A and B and also with a pump connection P and a tank connection T. This corresponds to the previously known prior art. This is also true for a load-holding valve 4, which is installed in the feed line to the hydraulic motor 1 and which is used to control the load as it is being lowered.

During operation in "lifting" mode, hydraulic oil flows from the pump connection P of the control valve 3 and the A line through the self-opening check valve of the load-holding valve 4 to the hydraulic motor 1 and thus drives it. Simultaneously, an identical amount of hydraulic oil flows from the hydraulic motor 1 via the B line back through the control valve 3 to the tank connection T. The proportional flow rate control is accomplished by the proportional control function of the control valve 3. This is shown in the hydraulic circuit diagram of the control valve 3.

During operation in "lowering" mode, the flow direction is reversed. The movement is controlled here by the proportionally controllable load-holding valve 4.

A reciprocating positive displacement machine is preferably used as the hydraulic motor 1 in applications of this type, such as the axial piston machine shown on page H5 of the book by Dubbel entitled "Taschenbuch für den Maschinenbau" ["Mechanical Engineering Handbook"], Springer-Verlag, 19th edition. This widely used type of machine, however, suffers from the disadvantage that its coefficient of cyclic variation is relatively high, and thus the delivery stream does not flow uniformly. It is even possible as a result that, at the very beginning of the process of lifting a load 2, that is, at very low rpm's of the hydraulic motor 1, the load 2 will actually drop slightly. This is also true when the rpm's are reduced to hold the load 2 in a certain position. It is hardly possible to work efficiently under these conditions and there is also a certain element of danger associated with this behavior.

Figure 2:
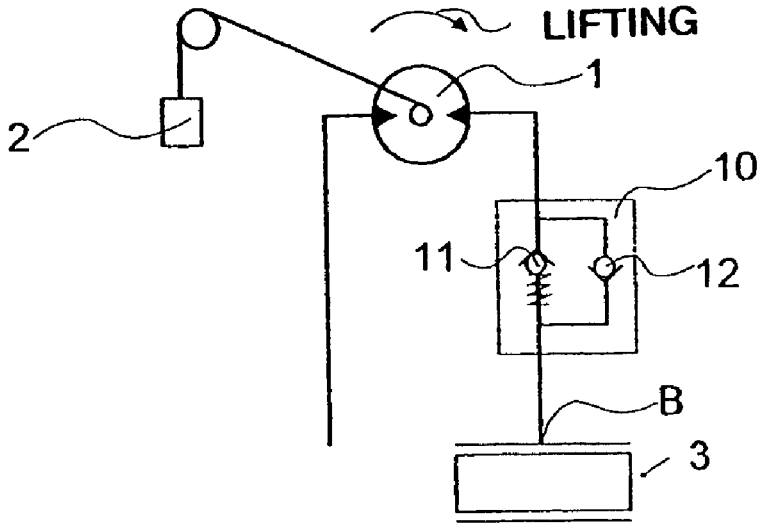
Fig. 2 (PRIOR ART)
FIG. 2 shows a valve assembly provided as a supplemental unit for the "lifting" function representing a solution according to the prior art.

To eliminate this problem at least in part, the attempt has been made to reduce the degree of nonuniform rotational movement during slow-speed operation by incorporating a valve assembly 10, for example, into the corresponding return line leading from the hydraulic motor 1, as shown in FIG. 2. The valve assembly 10 consists here of two parallel-connected check valves, namely, a spring-loaded check valve 11 and a non-spring-loaded check valve 12, installed in the course of the B line. The applicant himself created a valve assembly of this type in 2001. It is possible with this valve to compensate partially for the pressure fluctuations during operation in lifting mode. The hydraulic oil flowing from the hydraulic motor 1 to the control valve 3 must first pass through the valve assembly 10. Because the oil arrives at the non-spring-loaded check valve 12 in this valve's blocking direction, the valve performs its blocking function, which means that the hydraulic oil can flow only through the spring-loaded check valve 11, but it will do so only if its pressure is high enough to overcome the force of the pretensioning spring. As a result, the significant effect is created that, in a very simple way, the hydraulic motor 1 itself is hydraulically pretensioned, which has the effect of significantly improving the nonuniform startup behavior at low rpm's. The coefficient of cyclic variation of the rotational movement is improved.

A solution based on an additional valve assembly 10 of this type, however, is complicated and expensive in terms of manufacturing, and it also occupies valuable space. The invention is also based, however, on the very special task of improving the functionality of a solution of this type.

Figure 3:
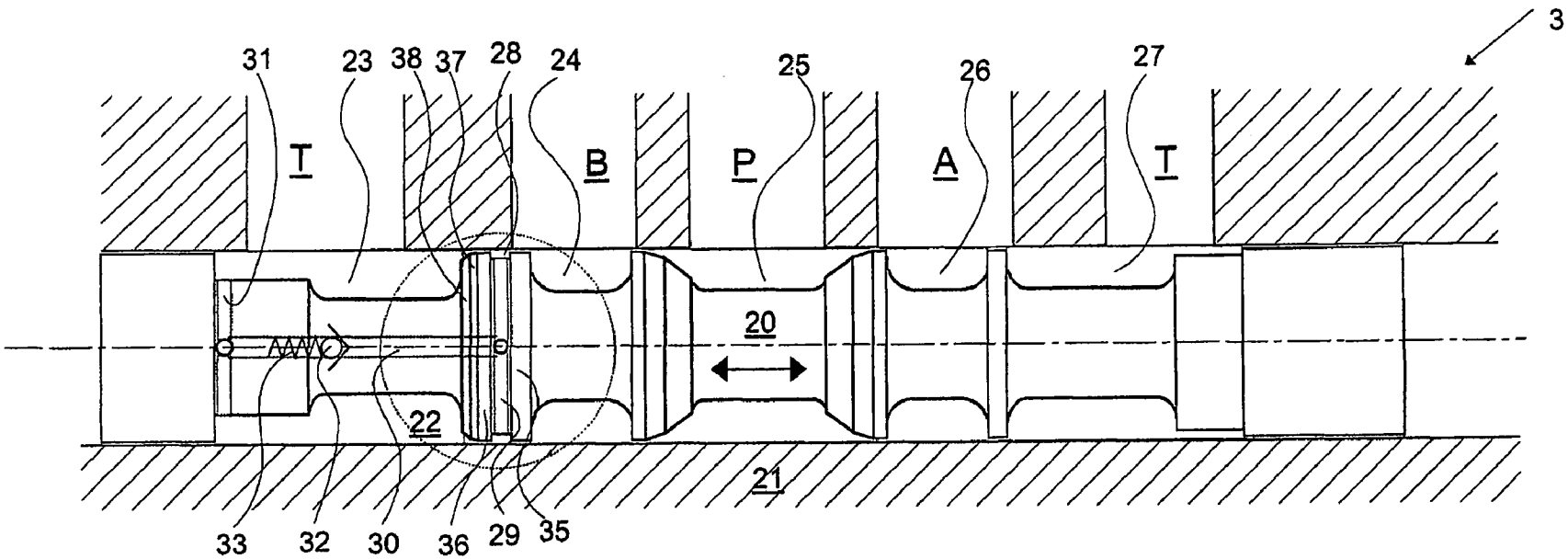
FIG. 3 shows a view of a control slide inside a valve body.

FIG. 3 shows a view of a control slide 20 inside a valve body 21, both belonging to the control valve 3. In a longitudinal bore 22 of the valve body 21, the control slide 20 is free to move axially back and forth, as indicated by a double arrow. The freedom of axial movement, as usual in proportional control valves of this type, is produced by at least one drive, for which purpose electrical, hydraulic, or pneumatic drives are used. Because in the present case neither the number of drives nor the type of drive is important with respect to the control slide 20, this drive is not shown in the figure.

As usual in control valves of this type, transverse bores which lead to the longitudinal bore 22 are present in the valve body 21. In FIG. 3, five of these transverse bores are shown, namely, in order from the right, a tank connection bore T, a first working connection bore A, a pump connection bore P, a second working connection bore B, and another tank connection bore T. For design reasons, two tank connection bores T are shown, which are usually merged inside the valve body 21. The background here is that, during operation, it must be possible for each of the working connection bores A, B to be connected in alternation to the tank connection bore T and then to the pump connection bore P so that both "lifting" and "lowering" operating modes are possible.

The control slide 20 has profiled annular grooves, which establish the various connections between the connection bores T, B, P, A, and T. From the left, these are a B-to-tank groove 23, a B control groove 24, a pump groove 25, an A control groove 26, and an A-to-tank groove 27. The principle is commonly used in most directional control valves.

The relative position of the control slide 20 in the longitudinal bore 22 in the diagram of FIG. 3 is such that the pump connection bore P is closed. There is therefore no connection to either one of the adjacent working connection bores A, B. It follows from this that the hydraulic motor 1 is at rest, because no hydraulic oil is being supplied to it. What is shown is therefore the "zero" or neutral position.

According to the invention, however, the illustrated control valve 3 for a hydraulic motor 1 (FIG. 1) has an additional narrow auxiliary control groove 28, located between the B-to-tank groove 23 and the B control groove 24. At the base of this auxiliary control groove 28, a first transverse bore 29 begins, which opens out into a longitudinal bore 30, the other end of which is connected to a second transverse bore 31. This second transverse bore 31 establishes a connection with the B-to-tank groove 23 and thus to the tank connection bore T. The most significant feature of the invention is now that a spring-loaded check valve 32 with a pretensioning spring 33 is installed in this longitudinal bore 30 in such a way that it can be opened by a higher pressure coming from the working connection bore B. The way in which this works will be described later in greater detail.

It is advantageous for the flow rate-controlling control surface located between the working connection bore B and the second tank connection bore T to have a special design. On both sides of the auxiliary control groove 28, the control slide 20 has a short cylindrical section, namely, a sealing cylinder 35 on the right of it and a pretensioning cylinder 36 on the left of it. Adjoining on the left are two truncated cone-shaped sections, namely, a first control cone section 37 with a shallower taper and then a second control cone section 38 with a steeper taper.

FIGS. 4-7 show the same part of the control valve 3, namely, the part inside the dotted circle in FIG. 3. The point here is to show how the task of the invention is accomplished advantageously by the inventive means.

Figure 4:
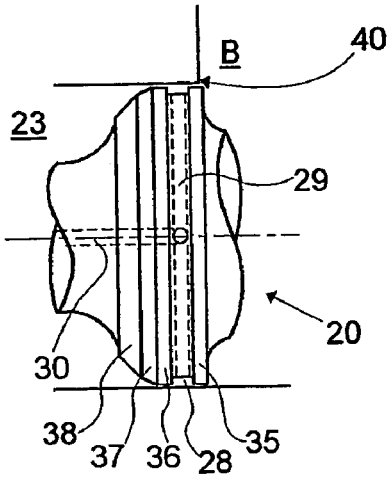
FIGS. 4-7 show part of the control slide in various positions relative to a control edge.

FIG. 4 shows that a control edge 40 assigned to the working connection bore B is in the area of the sealing cylinder 35. Thus there is no connection between the working connection bore B and the tank connection bore T further toward the left (FIG. 3). Because, therefore, the auxiliary control groove 28 and thus the beginning of the transverse bore 29 in it are covered by the control edge 40, the pressure prevailing in the working connection bore B does not act in the transverse bore 29. This state is present when, as shown in FIG. 3, the connection from the pump connection bore P is blocked both to the working connection bore A and to the working connection bore B, so that the hydraulic motor 1 (FIG. 1) is motionless. Here, too, the zero or neutral position is shown.

Figure 5:
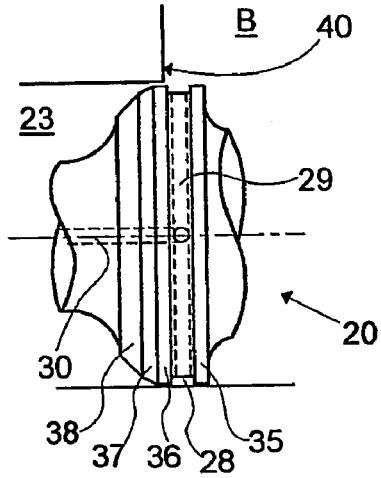

FIG. 5 shows the state in which the control slide 20 has been pushed to the right with respect to the control edge 40 so that now, because the auxiliary control groove 28 is freely exposed, the pressure prevailing in the working connection bore B can act in the transverse bore 29. In this state, the hydraulic motor 1 (FIG. 1) will now be turning. The reason for this is that, because of the rightward-shift of the control slide 20, hydraulic oil can now flow from the pump connection bore P to the first working connection bore A and from there to the hydraulic motor 1, as can be derived from FIG. 3. The hydraulic oil flowing back simultaneously from the hydraulic motor 1 to the tank, however, cannot take the direct route from the working connection bore B to the tank connection bore T located farther to the left, because this route is blocked by the sealing action of the pretensioning cylinder 36. The returning hydraulic oil therefore forces open the spring-loaded check valve 32 present in the longitudinal bore 30. As a result, the pressure in the working connection bore B rises correspondingly to a value which is determined by the force of the pretensioning spring 33 of the check valve 32 (FIG. 3).

As a result of this increase in pressure in the working connection bore B, the hydraulic motor 1 is hydraulically pretensioned, which has the result that the nonuniform startup at low rpm's is greatly improved in a very simple way. The coefficient of cyclic variation is therefore so low that there is practically no irregularity in the rotational movement during slow-speed startup. This also applies to slow-speed operation after a deceleration from high-speed operation.

Figure 6:
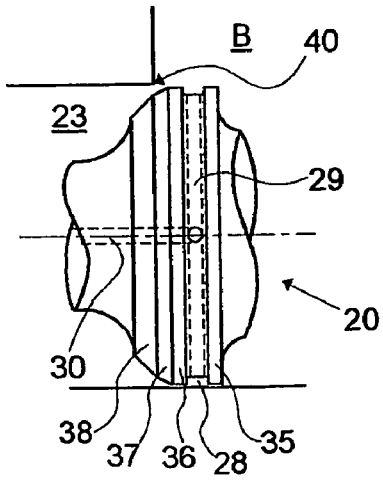

FIG. 6 shows the state present after the control valve 3 has been moved even farther and arrives in the position corresponding to operation in "lifting" mode. As a result of the further movement of the control slide 20 toward the right in comparison with FIG. 5, the control edge 40 is now located so that the first control cone section 37 with the shallower taper is to the right of the control edge 40. Thus, hydraulic oil can now flow between the control edge 40 and the first control cone section 37. In this state, the hydraulic oil flowing back from the hydraulic motor 1 (FIG. 1) to the tank flows both through the check valve 32 (FIG. 3) and via the annular cross section between the control edge 40 and the control cone section 37. The farther the control piston 20 moves toward the right, the greater the flow of hydraulic oil between the control edge 40 and the control cone section 37. The reason why the check valve 32 does not close when the control edge 40 arrives in the area of the first control cone section 37 is that the flow passing between the control edge 40 and the control cone section 37 creates a back-pressure equal to that present at the spring-loaded check valve 32.

Figure 7:
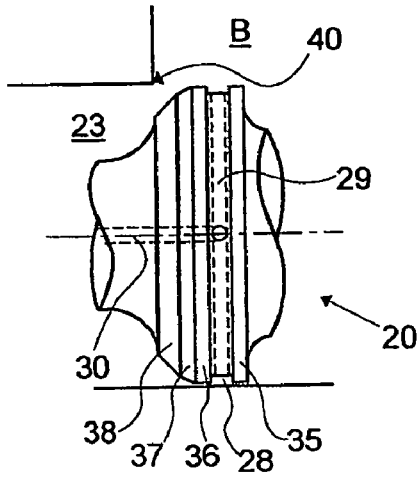

When the control slide 20 is moved even farther toward the right from the position shown in FIG. 6, namely, into the position shown in FIG. 7, in which the control edge 40 is now in the area of the second control cone section 38 with the steeper taper, the back-pressure resulting from the flow is lower because of the larger open cross section available to the hydraulic oil. As a result, the check valve 32 (FIG. 3) closes. Hydraulic oil therefore now flows only through the free space between the control edge 40 and the two control cone sections 37, 38. The flow rate of hydraulic oil and thus the rpm's of the hydraulic motor 1 are now so high, however, that the previously mentioned effect of a high coefficient of cyclic variation no longer occurs. With this larger open pass-through cross section, the flow resistance p is also reduced. This leads to less heating of the hydraulic oil, which offers yet another advantage.

It is advantageous for the pretensioning spring 33 to be designed so that the return flow pretension is approximately 25 bars.

It is advantageous for the taper of the first control cone section 37 to be designed so that the angle to the imaginary cylindrical surface of the control slide 20 is approximately 16°. It is advantageous for the taper of the second control section 38 to be approximately 26°. The dimensions depend otherwise on the size of the control valve 3, that is, on its maximum flow rate. No inventive activity is required to optimize these dimensions.

The invention can be applied wherever loads are to be lifted by machines with a hydraulic motor.

What is claimed is:

1. A control valve for a hydraulic motor used to lift loads, wherein the control valve is a directional control valve comprising:

a valve body having a longitudinal bore and a plurality of transverse bores leading to said longitudinal bore, said transverse bores comprising a first working connection bore, a second working connection bore, a pump connection bore, and a tank connection bore; and a control slide installed in the longitudinal bore with freedom to move axially, the control slide having a first working connection bore to tank groove, a first control groove, a pump groove, and a second control groove, the control slide further comprising:

an auxiliary control groove located between the first control groove and the first working connection bore to tank groove, the auxiliary control groove being limited on both sides by cylindrical sealing surfaces;

a longitudinal bore in the control slide;

a first transverse bore connecting the auxiliary control groove to the longitudinal bore in the control slide;

a second transverse bore connecting the first working connection bore to tank groove to the longitudinal bore in the control slide; and a spring-loaded check valve in the longitudinal bore in the control slide, wherein the check valve can be opened by flow from the first working connection bore via the auxiliary control groove and the first transverse bore in the control slide.

2. The control valve of claim 1 wherein the check valve is spring-loaded by a pre-tensioning spring having a return flow pretension of 25 bars.

3. The control valve of claim 1 wherein the control slide further comprises a first conical control section between one of the cylindrical sealing surfaces and the first working connection bore to tank groove.

4. The control valve of claim 3 wherein first conical control section has a surface with an angle of about 16 degrees to the axis of the longitudinal bore in the valve body.

5. The control valve of claim 3 wherein the control slide further comprises a second conical control section between the first conical control section and the first working connection bore to tank groove.

6. The control valve of claim 5 wherein second conical control section has a surface with an angle of about 26 degrees to the axis of the longitudinal bore in the valve body.

7. The control valve of claim 1 wherein the control slide further comprises a second working connection bore to tank groove.

8. The control valve of claim 7 wherein the valve body comprises two tank connection bores communicating with respective first and second working connection bore to tank grooves.

* * * * *